US005098102A

United States Patent [19]

Cooper

[11] Patent Number: 5,098,102

[45] Date of Patent: Mar. 24, 1992

[54] MECHANICALLY DRIVEN MOVEABLE JIGSAW PUZZLE PIECES HAVING A MAGNETIC COUPLING

[76] Inventor: John S. Cooper, 10791 Peoria Rd., Browns Valley, Calif. 95918

[21] Appl. No.: 332,159

[22] Filed: Apr. 3, 1989

[51] Int. Cl.[5] ..... A63F 9/08

[52] U.S. Cl. ..... 273/157 R; 273/456

[58] Field of Search ..... 273/153 S, 157 R, 85 A, 273/85 B, 156, 1 GP; 428/33; 446/135, 136, 137, 138; 464/29

[56] References Cited

U.S. PATENT DOCUMENTS 2,396,382 3/1946 Maibaum ..... 446/118
2,655,379 10/1953 Miller ..... 446/135
3,417,996 12/1968 Janiszewski ..... 273/157 R
4,508,348 4/1985 LaPointe ..... 273/157 R

*Primary Examiner*—Edward M. Coven
*Assistant Examiner*—William M. Pierce
*Attorney, Agent, or Firm*—Bernhard Kreten

[57] ABSTRACT

An animated jigsaw puzzle in which a support base carries in fixed relationship a variety of jigsaw puzzle pieces in a fixed configuration when assembled, the animation includes portions of the jigsaw puzzle pieces which are adapted to move in various mechanical manners, and a drive linkage connecting the animated motion to an underlying drive train contained below the support tray coupled through a drive belt to a prime mover for use by a young child.

14 Claims, 3 Drawing Sheets

MECHANICALLY DRIVEN MOVEABLE JIGSAW PUZZLE PIECES HAVING A MAGNETIC COUPLING

FIELD OF THE INVENTION

The following invention relates generally to toys. More specifically, the toy embraced by the instant invention is a jigsaw puzzle having a plurality of puzzle pieces including a depiction of a scene on an exposed top surface, with certain portions of the depicted scene capable of animation through a drive train system.

BACKGROUND OF THE INVENTION

Children of all ages are stimulated by the challenge associated with assembling a jigsaw puzzle. A plurality of intelocking pieces, once assembled, displays a picture and the process of solving the puzzle is a rewarding challenge. However, the skill required to assemble a complex puzzle may be beyond the scope of a neophyte on the one hand, or on the other hand a puzzle which is simple to assemble may lack the ability to hold the interest of the child after solving the puzzle.

SUMMARY OF THE INVENTION

The instant invention is distinguished over the known prior art in that a puzzle is provided which, like known prior art puzzles, varies in the complexity and the requisite skill necessary to assemble the puzzle. However, upon completion of the puzzle the puzzle includes an additional dimension: motion of components forming jigsaw puzzle pieces so that the assembled picture is capable of motion.

More particularly, the invention includes a support tray upon which a plurality of jigsaw puzzle pieces are to be placed in a specific configuration. Plural areas of operative interconnection between the tray and a jigsaw puzzle piece provide a drive type transmission to impart motion on a portion of a jigsaw puzzle piece so that an object displayed on a jigsaw puzzle piece can move to further entertain the puzzle solver.

The drive transmission communicates to a bottom surface of the tray wherein a drive linkage formed from a plurality of mechanical movements are coupled to a single drive belt whereby rotation of the drive belt through a power input knob drives the transmission and linkage to impart motion on a display area of the jigsaw puzzle pieces. The power input knob is carried on an exposed top surface of the tray for easy access by the puzzle solver.

OBJECTS OF THE INVENTION

Accordingly, it is a primary object of the present invention to provide a puzzle in which motion can be imparted to a display surface of various jigsaw puzzle pieces to animate the puzzle.

A further object of this invention is to provide a device as characterized above which enhances the enjoyment of a jigsaw puzzle solver.

A further object of this invention contemplates providing a device as characterized above which is durable in construction and is extremely safe to use for children of tender years.

A further object of this invention contemplates providing a device as characterized above which is sturdy and is capable of taking the kind of treatment expected from a young child.

A further object of this invention contemplates a device as characterized above in which a single power input will drive a series of animated displays on a single puzzle.

It is yet a further object of this invention to provide a device as characterized above in which plural different mechanical linkages are associated with the instant device to impart different types of motion.

From one vantage point, it is an object of the present invention to provide an animated jigsaw puzzle which provides a support means upon which a plurality of jigsaw puzzle pieces are placed, an animation means carried on the jigsaw puzzle pieces which imparts motion to depictions on an exposed outer surface of the jigsaw puzzle piece and drive means connecting the animation means to a prime mover to impart motion.

Viewed from another vantage point, it is an object to provide a jigsaw puzzle in which the drive means is an input knob which in turn drives a belt through a series of mechanical linkages of impart different types of motion to the exposed surface of the jigsaw puzzle piece thereby providing flexibility in artistic design.

From a further vantage point, it is an object of this invention to provide an animated jigsaw puzzle wherein various puzzle pieces are capable of being removed from the playing surface and yet when reassembled can be readily coupled to the drive system through a magnetic transmission which locks the animated portion to the drive mechanism such that the animation is in phase and operates in concert other animations associated with a single jigsaw puzzle without a need to initialize the cooperation of various moving elements.

These and other objects will be made manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENT

Figure 2:
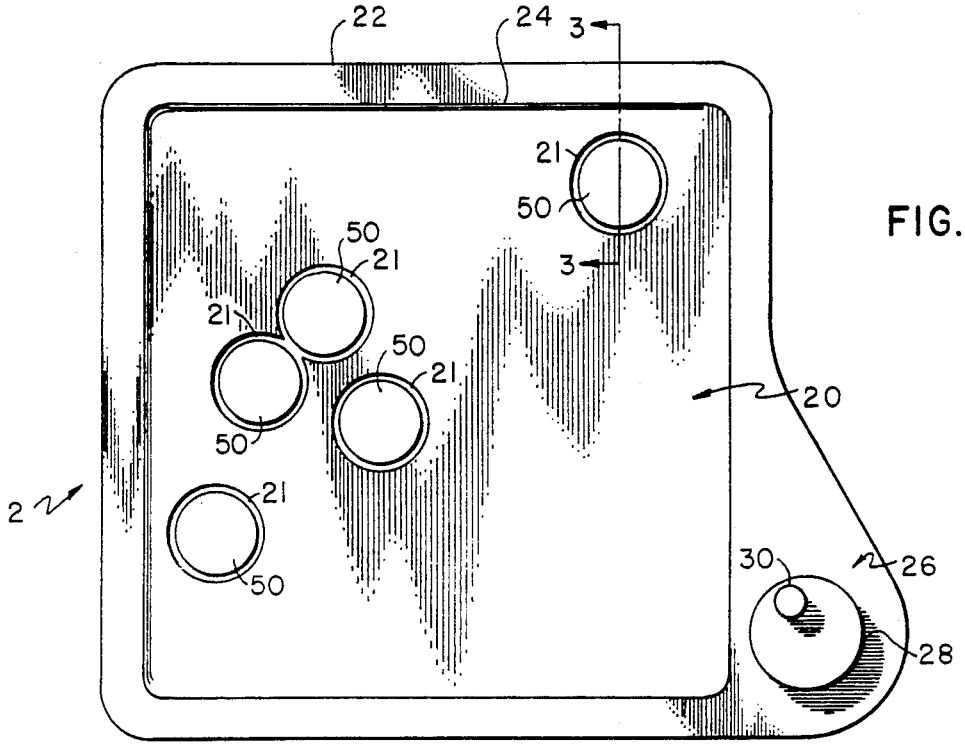
FIG. 2 is a top plan view of that which is shown in FIG. 1 with the jigsaw puzzle pieces removed for clarity.

Referring to the drawings now, wherein like reference numerals refer to like parts throughout the various drawing figures, reference numeral 10 is directed to the animated jigsaw puzzle according to the present invention.

Figure 3:
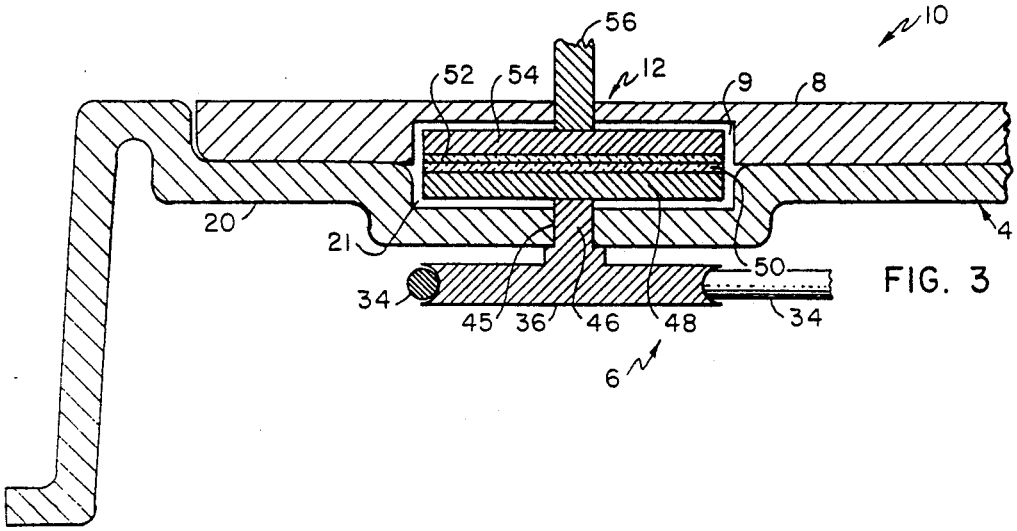
FIG. 3 is a sectional view taken along lines 3—3 of FIG. 2.

In its essence (FIG. 3), the jigsaw puzzle 10 includes a tray 20, a plurality of jigsaw puzzle pieces 8 having diverse peripheral borders adapted to be oriented in such a manner that a given jigsaw puzzle is "solved", a drive transmission 12 extending from the tray 20 to the jigsaw puzzle pieces 8 so that motion can be imparted to a portion of a jigsaw puzzle piece, and a drive linkage 6 carried on a bottom surface 4 of the tray to allow various moving pieces of the jigsaw puzzle to operate in synchrony.

Figure 1:
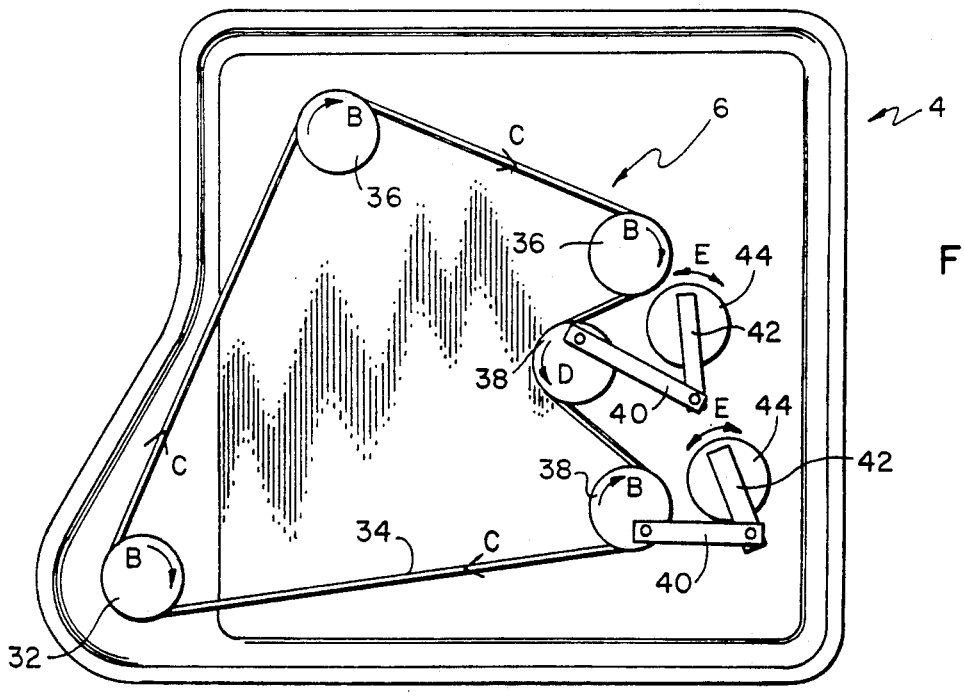
FIG. 1 is a bottom plan view of the apparatus according the present invention.

Referring more particularly to FIGS. 1 and 2, which show respectively a bottom surface 4 and a top surface 2, the puzzle 10 exclusive of the jigsaw pieces will be considered first.

FIG. 2 reveals that a tray 20 is formed on the top surface 2 defined as a centrally depressed area having a peripheral border 22 and a shelf wall 24 which defines a sunken portion defining the tray 20. The height of the shelf wall 24 can generally correspond to the thickness of a jigsaw piece 8 so that the peripheral border 22 acts as a frame circumscribing a completed puzzle. The frame border 22 holds the pieces in a preferred orientation so that the animated motion can be imparted to the jigsaw pieces 8 reliably. The border 22 includes an outwardly extending housing 26 at one corner thereof which serves as a support for a prime mover 28, for purposes to be assigned.

The tray 20 has a plurailty of recesses 21 strategically oriented about the tray surface within which a magnetic driving disk 50 is supported upon a driven magnetic support disk 48. See FIGS. 3 and 5. The recess 21 also includes a central opening 45 through which a drive shaft 46 passes having a free end integrally formed with a driven pulley 36 to impart motion to the magnetic driving disk 50.

In addition, each jigsaw piece 8 includes a corresponding recess 9 overlying the recess 21 on the tray 20. The recess 9 of the jigsaw piece 8 receives a second magnet 52 defining a magnetic driven disk 52 supported by a magnetic disk support 54. The disk support 54 carries an output shaft 56 that extends through a top surface of the jigsaw piece 8 and connects to the animated portion of the jigsaw puzzle that moves.

Figure 5:
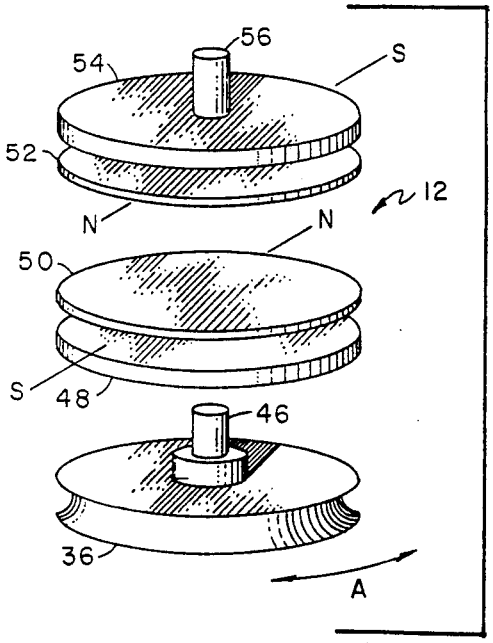
FIG. 5 is an exploded parts view of a portion of that which is shown in FIG. 3 showing how the drive transmission clutches the jigsaw puzzle pieces with the drive system.

FIG. 5 elaborates the drive transmission 12 further. As shown, the two magnetic disks, i.e. the driving disk 50 and driven disk 52 have inherent polarization as described in the drawing figure. Thus, rotation of the driven pulley 36 about its drive shaft 46 in the direction of the double ended arrow A will cause initial isolated motion of the driving disk 50 until the polarities are opposite (as shown in FIG. 5) when the polarities "click" and operatively drive the output shaft 56 through disk 52. In this manner, there may be some relative motion between the disks 50 and 52 until proper polarity orientation where upon positive driving takes place.

The magnetic disks 50, 52 are in tangential registry along the interface between the tray 20 and the jigsaw piece 8. Because of the polar attraction, synchronizing various moving portions of the jigsaw puzzle are not necessary since certain slippage will occur until the polarities align providing positive drive.

The means by which a driven pulley 36 can drive the output shaft 56 can now be explained with particular reference to FIG. 1. There shown, the drive linkage 6 includes a drive pulley 32 which is operatively coupled to the power input knob 28 (FIG. 2) for driving the puzzle. The input knob 28 includes a crank 30 for ergometric efficiency for the small hands of a child. The drive pulley 32, in conjunction with an elongate drive belt 34 forms a closed power loop and drives a plurality of driven pulleys 36 and compound driven pulleys 38.

Assume that the drive pulley 32 is rotated in the direction of the arrow B shown in FIG. 1. This imparts motion of the driven belt 34 in the direction of the arrow C as shown which in turn allows the first two driven pulleys 36 to rotate clockwise (arrow B) for continuous unidirectional rotation imparted through the tray 20 and its housing and on to the jigsaw playing pieces. Reference 38 is directed to a compound driven pulley 38 the first of which is driven counter clockwise (arrow D) and another compound driven pulley 38 rotating clockwise (arrow B). Each of the compound driven pulleys are connected to a first linkage 40 and then the first linkage 40 is directly connected to a driven link 42 as shown. This imparts an oscillatory motion (E) to a driven disk 44 when the object to be animated on the jigsaw puzzle piece is merely to oscillate about two limited positions.

Figure 4:
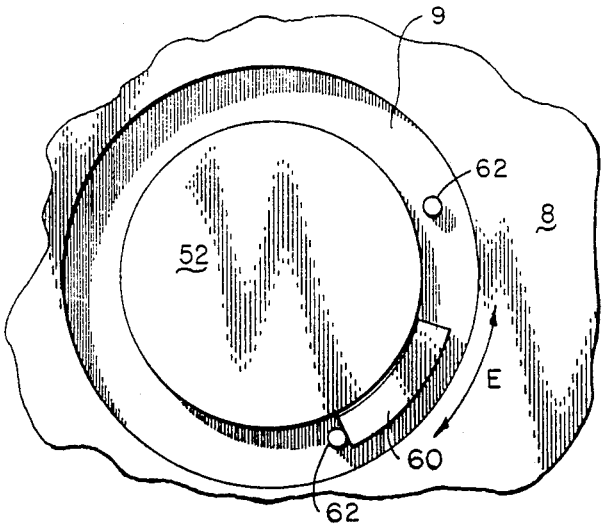
FIG. 4 is a bottom plan view showing an alternative detail for one of the drive transmission pieces.

FIG. 4 reflects a further refinement when using the compound driven pulley 38 and its driven disk 44 (of FIG. 1) to assure crisp oscillatory motion. The magnetic disk support 54 (of FIG. 5) which carries magnetic driven disk 52 includes a lobe 60 (of FIG. 4) extending from a peripheral side wall. The lobe 60 permits oscillatory motion about the arrow E and within the limits proscribed by stop pins 62. Therefore, alignment of the magnetic disks via polarity, within the constraints imposed by the stop pins 62 will assure that the animated figure on the exposed jigsaw surface is coordinated with other motions and not be "inverted" or "out of phase" with respect to other animation.

Figure 6:
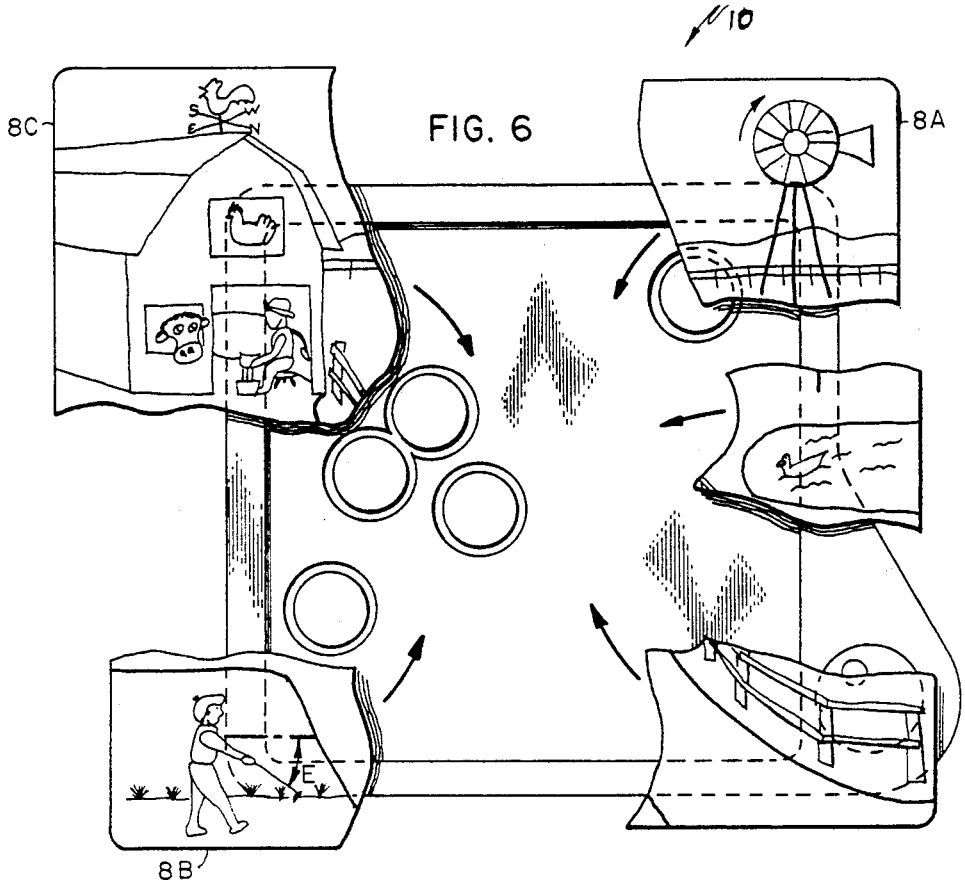
FIG. 6 is an exploded parts view of the jigsaw pieces to be placed on the top surface of FIG. 2 according to the present invention.
Figure 7:
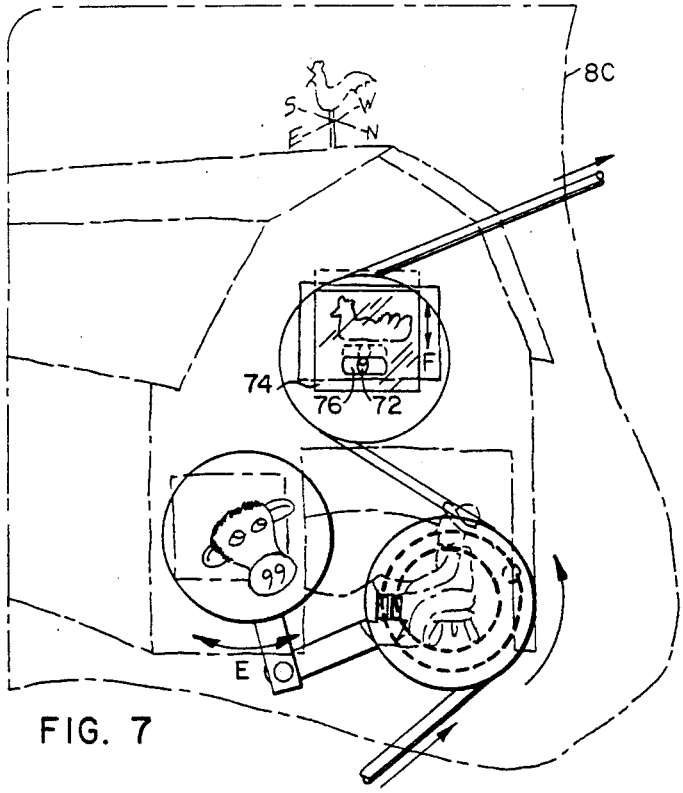
FIG. 7 is a top plan view of one of the jigsaw puzzle pieces with the underlying drive mechanism shown.

The significance of the foregoing structure can perhaps be best understood when viewing FIGS. 6 and 7. Jigsaw piece 8A depicts a windmill driven by pure rotary motion from the first driven pulley 36 after ("downstream") drive pulley 32.

Jigsaw piece 8B exemplifies oscillatory motion depicted as a farm boy hoeing the garden. The motion E of FIG. 6 corresponds to motion imparted via the last oscillating disk 44 just "upstream" from the drive pulley 32. The lobe 60 (FIG. 4) and stop pins 62 assure the arm motion of the farm boy will always be anatomically correct (i.e. in front of the boy).

Jigsaw piece 8C illustrates a chicken raising and lowering upon her nest of eggs, the oscillatory motion of a cow's head and cow milk being extracted. Whereas, in puzzle piece 8B only the oscillating disk 44 provided a display, in FIG. 8C both the oscillating disk 44 and the compound driven pulley 38 provide animation. With respect to the remaining disk on the puzzle piece 8C driven by disk 36 (in the cluster of three disks) the chicken moves up and down (arrow F) illustrating a cam pin 72 and slide mechanism 74 which converts rotary motion to linear reciprocal motion through slot 76.

It should be clear that various other drawings or depictions could be placed on the exposed top surface of the jigsaw puzzle pieces. Thus, the "farm" scene is merely illustrative.

Although the description of the drive linkage 6 chose pure rotation and oscillatory motion, it is clear that other types of motion can be effected by different mechanical movements, such as can be derived through cams, gears, slides, lost motion couplings, and the like. Thus, various types of animated jigsaw puzzles and displays may be included according to the present invention.

In addition, it is also possible to couple the prime mover housing 26 with a music box so that an appropriate tune can accompany the scene which defines the jigsaw puzzle.

Moreover, having thus described the invention, it should be apparent that numerous structural modifications and adaptations may be resorted to without departing from the scope and fair meaning of the invention as described hereinabove and as defined hereinbelow in the claims.

I claim:

1. An animated jagsaw puzzle formed from plural pieces which, when assembled forms a picture, comprising, in combination:

a support means upon which a plurality of said jigsaw puzzle pieces 8 are placed said plural jigsaw puzzle pieces each having an irregular shape which when all said pieces are correlated reform the picture, means carried on said jigsaw puzzle pieces which depicts motion to an exposed outer surface of said jigsaw puzzle pieces, thereby animating said pieces, drive means connecting said animated jigsaw puzzle pieces to a prime mover 28 to impart motion, wherein said drive means includes said first and second magnetic means, said first magnetic means 50 carried on said support means and said second magnetic means 52 on a bottom surface of said jigsaw puzzle piece to engage and drive said animated jigsaw puzzle pieces on said exposed outer surface of said jigsaw puzzle pieces, wherein said drive means includes a driven pulley 36 operatively connected to said first magnetic means to rotate and drive said animated jigsaw puzzles pieces, wherein plural animated jigsaw puzzle pieces and plural magnetic means 12 are provided all interconnected through pulley 36 means by a common belt driven by a prime mover, wherein said prime mover is a power input knob.

2. An animated jigsaw puzzle means formed from plural pieces which, when assembled forms a picture and said plural jigsaw puzzle pieces each having an irregular shape which when all said pieces are correlated reform the picture having a drive means 6 which drives a belt through a series of mechanical linkages to impart different types of motion to an exposed outer surface of said jigsaw puzzle thereby providing flexibility in artistic design, wherein said drive means includes said first and second magnetic means, said first magnetic means carried on tray support means 20 and said second magnetic means on a bottom surface of a jigsaw puzzle piece to engage an animated means on said exposed outer surface of said jigsaw puzzle, wherein said drive means includes a driven pulley operatively connected to said first magnetic means to rotate and drive said animated means, wherein plural animated means and plural magnetic means are provided all interconnected through pulley means by a common belt and driven by a primer mover, wherein said prime mover is a power input knob.

3. An animated jigsaw puzzle which forms a picture and is formed from a set of various puzzle pieces said plural jigsaw puzzle pieces each having an irregular shape which when all said pieces are correlated reform the picture all of which are removable from a playing surface and when reassembled said animated jigsaw puzzle piece is readily coupled to a drive system 6 comprising:

a magnetic transmission means which locks an animated portion to said drive system such that the animation is in phase and operates in concert other animations associated with jigsaw puzzle withoug a need to initialize the cooperation of various moving elements, wherein said drive means includes first and second magnetic means, said first magnetic means carried on tray support means and said second magnetic means carried on a bottom surface of said jigsaw puzzle piece to drivingly engage said animated means on said exposed outer surface of said jigsaw puzzle, wherein said drive means includes a driven pulley operatively connected to said first magnetic means to rotate and drive said animation means, wherein plural animated means and plural magnetic means are provided all interconnected through pulley means by a common belt and driven by a prime mover, wherein said prime mover is a power input knob.

4. An animated jigsaw puzzle which, when assembled forms a picture formed from plural pieces said plural jigsaw puzzle pieces each having an irregular shape which when all said pieces are correlated reform the picture, comprising in combination:

animation means on a said puzzle piece which moves, providing animation, a drive linkage for coupling to said animation means to move said animation means, transmission means forms from first and second magnetic elements which are removably coupled, such that when coupled, inherent polarization of said magnetic elements causes proper orientation and alignment between said magnetic elements, said transmission means interposed between said drive linkage and said animation means to allow said puzzle pieces to be removed from said drive linkage and replaced in an orientation in which the animation correlates to a scene on the puzzle.

5. An animated jigsaw puzzle which, when assembled forms a picture formed form a plurality of interlocking puzzle pieces said plural jigsaw puzzle pieces each having an irregular shape which when all said pieces are correlated reform the picture, comprising in combination:

a support tray upon which said puzzle pieces are placed, means on an exposed upper face of at least one puzzle piece, remote from said tray, which depicts both a stationary visual indicium of the puzzle and an exhibitor which is movable, a drive linkage carried by said tray, a magnetic drive transmission disposed between said tray and said puzzle piece which has said movable exhibitor, said magnetic drive transmission drivingly coupling said moveable exhibitor to said drive linkage on said tray for rotating said moveable exhibitor, and means to drive said drive linkage.

6. An animated jigsaw puzzle which, when assembled forms a picture, comprising, in combination:

a support means upon which a plurality of jigsaw puzzle pieces are placed said plural jigsaw puzzle pieces each having an irregular shape which when all said pieces are correlated reform the picture, animation means carried on said jigsaw puzzle pieces which imparts motion to depictions on an exposed outer surface of said jigsaw puzzle pieces, drive means connecting said animation means to a prime mover to impart motion, wherein said prime mover includes a power input knob, wherein said drive means includes said first and second magnetic means, said first magnetic means carried on said support means and said second magnetic means on a bottom surface of said jigsaw puzzle piece to engage and drive said animation means on said exposed outer surface of said jigsaw puzzle pieces.

7. The puzzle of claim 6 wherein said drive means includes a driven pulley operatively connected to said first magnetic means to rotate and drive said animation means.

8. The puzzle of claim 7 wherein plural animation means and plural magnetic means are provided all interconnected through pulley means by a common belt and driven by a prime mover.

9. An animated jigsaw puzzle means which, when assembled forms a picture formed from plural jigsaw puzzle pieces said plural jigsaw puzzle pieces each having an irregular shape which when all said pieces are correlated reform the picture having a drive means which drives a belt through a series of mechanical linkages to impart different types of motion to an exposed outer surface of said jigsaw puzzle thereby providing flexibility in artistic design, wherein said drive means includes a power input knob, wherein said drive means includes said first and second magnetic means, said first magnetic means carried on support means and said second magnetic means carried on a bottom surface of a jigsaw puzzle piece to engage an animated means on said exposed outer surface of said jigsaw puzzle.

10. The puzzle of claim 9 wherein said drive means includes a driven pulley operatively connected to said first magnetic means to rotate and drive said animated means.

11. The device of claim 10 wherein plural animated means and plural magnetic means are provided all interconnected through pulley means by a common belt and driven by a prime mover.

12. An animated jigsaw puzzle which, when assembled forms a picture having various puzzle pieces which are removable from a playing surface said plural jigsaw puzzle pieces each having an irregular shape which when all said pieces are correlated reform the picture and when reassembled are readily coupled to a drive system comprising:

a magnetic transmission means which locks an animated portion to said drive system such that the animation is in phase and operates in concert other animations associated with said jigsaw puzzle without a need to initialize the cooperation of various moving elements, wherein said drive system includes a power input knob, wherein said drive means includes first and second magnetic means, said first magnetic means carried on support means and said second magnetic means carried on a bottom surface of said jigsaw puzzle piece to drivingly engage said animated means on said exposed outer surface of said jigsaw puzzle.

13. The puzzle of claim 12 wherein said drive means includes a driven pulley operatively connected to said first magnetic means to rotate and drive said animation means.

14. The puzzle of claim 13 wherein plural animated means and plural magnetic means are provided all interconnected through pulley means by a common belt and driven by a prime mover.

* * * * *